US006341752B1

(12) United States Patent
Green

(10) Patent No.: US 6,341,752 B1
(45) Date of Patent: Jan. 29, 2002

(54) GOLF TEE SUPPORT

(76) Inventor: Vincent L. Green, 1319 Bonner Ave., Santee, SC (US) 29142

( * ) Notice: Subject to any disclaimer, the term of this patent is extended or adjusted under 35 U.S.C. 154(b) by 0 days.

(21) Appl. No.: 09/512,447

(22) Filed: Feb. 25, 2000

(51) Int. Cl.[7] ..... A45F 3/44; A63B 69/36
(52) U.S. Cl. ..... 248/156; 273/207
(58) Field of Search ..... 248/156, 542; 273/207, 208, 33; 473/387

(56) References Cited

U.S. PATENT DOCUMENTS

| | | | | | |
|---|---|---|---|---|---|
| D82,059 | S | | 9/1930 | Sargent | |
| 2,146,736 | A | * | 2/1939 | Hammond et al. | 273/33 |
| 2,470,817 | A | * | 5/1949 | Hendricks | 273/33 |
| 2,839,304 | A | | 6/1958 | Lerick | |
| 4,524,974 | A | * | 6/1985 | Matsuura | 273/207 |
| 4,645,208 | A | | 2/1987 | Morabeto | |
| 4,786,054 | A | * | 11/1988 | Keys | 273/33 |
| 4,989,869 | A | | 2/1991 | Lackey | |
| 4,993,708 | A | * | 2/1991 | Prosser et al. | 273/26 R |
| 5,242,170 | A | | 9/1993 | Ward | |
| 5,413,348 | A | * | 5/1995 | Basso | 273/208 |
| 5,672,121 | A | * | 9/1997 | Miller | 473/386 |
| D430,913 | S | * | 9/2000 | Lovelace | D21/718 |

* cited by examiner

*Primary Examiner*—Ramon O. Ramirez
*Assistant Examiner*—Jerome A. DeLuca

(57) ABSTRACT

A golf tee support for preventing movement of the tee after the golf ball is hit. The golf tee support includes a housing having a top wall, a bottom wall and a peripheral wall extending therebetween. The top wall has a bore therein. A coil spring has a first end and a second end. The first end of the coil spring is fixedly mounted on the bottom wall of the housing. A rod has a first end and a second end. The first end of the rod is tapered to a pointed tip. The second end of the rod is fixedly coupled to the second end of the spring.

8 Claims, 1 Drawing Sheet

GOLF TEE SUPPORT

BACKGROUND OF THE INVENTION

1. Field of the Invention

The present invention relates to golf tees and more particularly pertains to a new golf tee support for preventing movement of the tee after the golf ball is hit.

2. Description of the Prior Art

The use of golf tees is known in the prior art. More specifically, golf tees heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,242,170; 2,839,304; 5,413,348; 4,998,732, U.S. Des. Pat. No. 91,150, and U.S. Pat. Nos. 3,966,214; 3,606,344.

While these devices fulfill their respective, particular objectives and requirements, the aforementioned patents do not disclose a new golf tee support. The inventive device includes a housing having a top wall, a bottom wall and a peripheral wall extending therebetween. The top wall has a bore therein. A coil spring has a first end and a second end. The first end of the coil spring is fixedly mounted on the bottom wall of the housing. A rod has a first end and a second end. The first end of the rod is tapered to a pointed tip. The second end of the rod is fixedly coupled to the second end of the spring.

In these respects, the golf tee support according to the present invention substantially departs from the conventional concepts and designs of the prior art, and in so doing provides an apparatus primarily developed for the purpose of preventing movement of the tee after the golf ball is hit.

SUMMARY OF THE INVENTION

In view of the foregoing disadvantages inherent in the known types of golf tees now present in the prior art, the present invention provides a new golf tee support construction wherein the same can be utilized for preventing movement of the tee after the golf ball is hit.

The general purpose of the present invention, which will be described subsequently in greater detail, is to provide a new golf tee support apparatus and method which has many of the advantages of the golf tees mentioned heretofore and many novel features that result in a new golf tee support which is not anticipated, rendered obvious, suggested, or even implied by any of the prior art golf tees, either alone or in any combination thereof.

To attain this, the present invention generally comprises a housing having a top wall, a bottom wall and a peripheral wall extending, therebetween. The top wall has a bore therein. A coil spring has a first end and a second end. The first end of the coil spring is fixedly mounted on the bottom wall of the housing. A rod has a first end and a second end. The first end of the rod is tapered to a pointed tip. The second end of the rod is fixedly coupled to the second end of the spring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, not is it intended to be limiting as to the scope of the invention in any way.

It is therefore an object of the present invention to provide a new golf tee support apparatus and method which has many of the advantages of the golf tees mentioned heretofore and many novel features that result in a new golf tee support which is not anticipated, rendered obvious, suggested, or even implied by any of the prior art golf tees, either alone or in any combination thereof.

It is another object of the present invention to provide a new golf tee support which may be easily and efficiently manufactured and marketed.

It is a further object of the present invention to provide a new golf tee support which is of a durable and reliable construction.

An even further object of the present invention is to provide a new golf tee support which is susceptible of a low cost of manufacture with regard to both materials and labor, and which accordingly is then susceptible of low prices of sale to the consuming public, thereby making such golf tee support economically available to the buying public.

Still yet another object of the present invention is to provide a new golf tee support which provides in the apparatuses and methods of the prior art some of the advantages thereof, while simultaneously overcoming some of the disadvantages normally associated therewith.

Still another object of the present invention is to provide a new golf tee support for preventing movement of the tee after the golf ball is hit.

Yet another object of the present invention is to provide a new golf tee support which includes a housing having a top wall, a bottom wall and a peripheral wall extending therebetween. The top wall has a bore therein. A coil spring has a first end and a second end. The first end of the coil spring is fixedly mounted on the bottom wall of the housing. A rod has a first end and a second end. The first end of the rod is tapered to a pointed tip. The second end of the rod is fixedly coupled to the second end of the spring.

Still yet another object of the present invention is to provide a new golf tee support that has a bore therein for receiving a tee.

Even still another object of the present invention is to provide a new golf tee support that keeps the tee at a predetermined height after the hit so that beginning golfers do not have to constantly adjust a new tee after every hit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
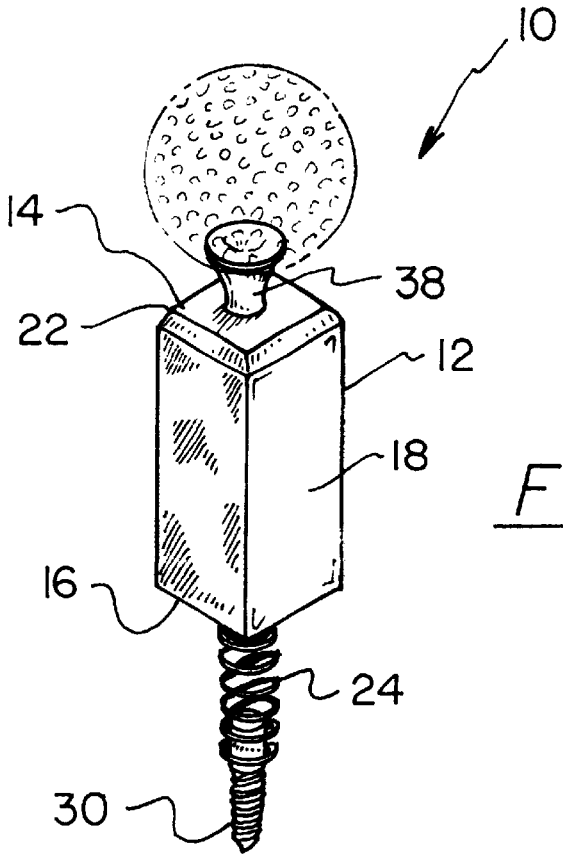
FIG. 1 is a schematic perspective view of a new golf tee support according to the present invention.
Figure 2:
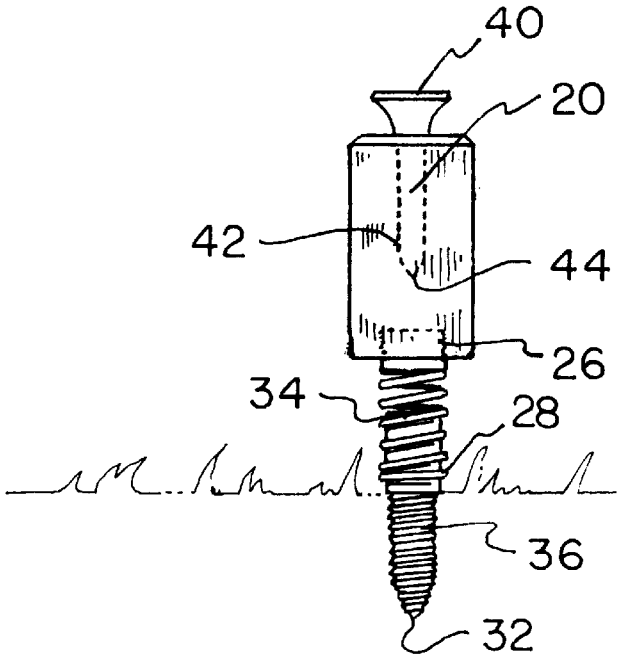
FIG. 2 is a schematic side view of the present invention.

With reference now to the drawings, and in particular to FIGS. 1 and 2 thereof, a new golf tee support embodying the principles and concepts of the present invention and generally designated by the reference numeral 10 will be described.

As best illustrated in FIGS. 1 and 2, the golf tee support 10 generally comprises a housing 12 having a top wall 14, a bottom wall 16 and a peripheral wall 18 extending therebetween. The housing 12 is substantially solid. The top wall 14 has a bore 20 therein. The bore 20 has a depth generally between one and two inches. The top 14 and bottom walls 16 have a generally rectangular shape. A juncture 22 of the peripheral wall 18 and the top wall 14 forms an angled edge. The peripheral wall 18 preferably has a height between one and three inches. The top wall 14 has a width preferably between one inch and one and a half inches. Ideally, the housing 12 is made from an elastomeric material.

A coil spring 24 has a first end 26 and a second end 28. The first end 26 of the coil spring is fixedly mounted on the bottom wall 16 of the housing.

A rod 30 has a first end 32 and a second end 34. The rod 30 has an exterior surface 36, which is threaded. The first end 32 of the rod 30 is tapered to a pointed tip 36. The second end 34 of the rod 30 is fixedly coupled to the second end 28 of the coil spring 24 such that the second end 34 is received in a portion of a center channel of the coil spring 24. The first end 32 of the rod 30 is insertable in a ground surface.

A tee 38 has a head portion 40 adapted for resting a golf ball upon. The tee has a bottom portion 42. The bottom portion 42 has a pointed end 44. The pointed end 44 is removably insertable in the bore 20 in the housing 12. The head portion 40 has a width substantially equal to one-half a width of the housing 12.

In use, the pointed tip 32 of the rod portion 30 is placed in the ground. The tee 38 is placed in the bore 20 and a golf ball is placed on the tee 38. When the golf ball is hit, the tee 38 stays in its place and a the desired height.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf tee support, said support comprising:

a housing, said housing having a top wall, a bottom wall and a peripheral wall extending therebetween, said top wall having a bore therein;

a coil spring, said coil spring having a first end and a second end, said first end of said coil spring being fixedly mounted on said bottom wall of said housing;

a rod, said rod having a first end and a second end, said first end of said rod being tapered to a pointed tip, said second end of said rod being fixedly coupled to said second end of said coil spring;

wherein said bore has a depth generally between one and two inches wherein said top and bottom walls have a generally rectangular shape, a juncture of said peripheral wall and said top wall forming an angled edge wherein said housing comprises an elastomeric material.

2. The golf tee support as in claim 1, wherein said rod has an exterior surface, said exterior surface of said rod being threaded, said first end of said rod being insertable in a ground surface.

3. A golf tee support system, said system comprising:

a housing, said housing having a top wall, a bottom wall and a peripheral wall extending therebetween, said housing being substantially solid, said top wall having a bore therein, said bore having a depth generally between one and two inches, said top and bottom walls having a generally rectangular shape, a juncture of said peripheral wall and said top wall forming an angled edge, said housing being made from an elastomeric material;

a coil spring, said coil spring having a first end and a second end, said first end of said coil spring being fixedly mounted on said bottom wall of said housing;

a rod, said rod having a first end and a second end, said rod having an exterior surface, said exterior surface of said rod being threaded, said first end of said rod being tapered to a pointed tip, said second end of said rod being fixedly coupled to said second end of said coil spring, said second end being received in a portion of a center channel of said coil spring, said first end of said rod being insertable in a ground surface; and a tee, said tee having a head portion adapted for resting a golf ball upon, said tee having a bottom portion, said bottom portion having a pointed end, said pointed end being removably insertable in said bore in said housing, said head portion having a width substantially equal to one-half a width of said housing.

4. A golf tee support comprising:

a housing having a top, a bottom and a peripheral wall extending therebetween, said top having a bore therein for removably receiving a lower portion of a tee;

a spring having a first end and a second end, said first end of said spring being fixedly mounted on said bottom of said housing;

a rod having a first end and a second end, said first end of said rod being tapered to a pointed tip, said second end of said rod being fixedly coupled to said second end of said spring.

said housing being formed of an elastomeric material.

5. The golf tee support as in claim 4, wherein said bore has a depth measuring generally between one and two inches.

6. The golf tee support as in claim 4, wherein said top and said bottom of said housing each have a generally rectangular shape, a juncture of said peripheral wall and said top wall forming an angled edge.

7. The golf tee support as in claim 4, wherein said rod has an exterior surface, a portion of said exterior surface of said rod being threaded, said first end of said rod being insertable in a ground surface.

8. The golf tee support as in claim 4, wherein the second end of said rod and the bottom of said housing are spaced with respect to each other for facilitating movement of said housing with respect to said rod, said spring extending between said rod and said housing.

* * * * *